United States Patent [19]

Sherwood

[11] 4,197,945

[45] Apr. 15, 1980

[54] PIN PROTECTOR

[75] Inventor: Theodore R. Sherwood, Sunnyvale, Calif.

[73] Assignee: The United States of America as represented by the Secretary of the Navy, Washington, D.C.

[21] Appl. No.: 728,497

[22] Filed: Sep. 30, 1976

[51] Int. Cl.[2] ..... B65D 73/02

[52] U.S. Cl. ..... 206/328; 24/3 E; 24/73 MF; 24/81 CC; 24/137 R; 24/257; 174/138 G; 339/36

[58] Field of Search ..... 24/3 E, 11 P, 67.5, 24/67.9, 73 A, 73 MF, 81 CC, 137 R, 255, 257 R, 259 PW; 174/138 D, 138 F, 138 G; 206/328-329, 526-527; 317/101 DH; 339/36, 44 R

[56] References Cited

U.S. PATENT DOCUMENTS

| | | | |
|---|---|---|---|
| 3,019,500 | 2/1962 | Duffin et al. | 24/255 R X |
| 3,225,922 | 12/1965 | Straight | 24/81 CC |
| 3,322,381 | 5/1967 | Bubb | 24/255 P |
| 3,388,227 | 6/1968 | Basso et al. | 24/137 R |

FOREIGN PATENT DOCUMENTS

| | | | |
|---|---|---|---|
| 1533316 | 6/1968 | France | 206/328 |

*Primary Examiner*—Herbert F. Ross

*Attorney, Agent, or Firm*—R. S. Sciascia; Charles D. B. Curry; Francis I. Gray

[57] ABSTRACT

An apparatus to removably enclose and thereby protect electrical connector pins attached to circuit boards. The pin protector has parallel flanges and a hinge to provide for the opening of an enclosing section to allow it to be placed about the pins. The memory properties of the hinge force the enclosing section to remain securely positioned. The pin protector is formed from an extrusible material and thus can be manufactured in any length without requiring the mold to be changed.

4 Claims, 4 Drawing Figures

PIN PROTECTOR

BACKGROUND OF THE INVENTION

1. Field of the Invention

The present invention relates to the field of protectors for electrical connector pins and, more particularly, to pin protectors formed from an extrusible material.

2. Description of the Prior Art

The basic problem addressed by the present invention is protecting wire electrical connector pins installed in electronic circuit boards during the storage or the shipping of such assemblies. Such protection has been found necessary to protect the thin, fragile pins from being bent or broken by inadvertent contact with foreign objects.

Presently, protection is provided inserting the pins into polyurethane foam blocks. This method has been found unsatisfactory because the act of insertion often results in the bending or breaking of the pins as well as because the bulk of the blocks takes up a large amount of storage space and makes transportation of the protected assemblies cumbersome. In addition, the polyurethane foam is abrasive. The pins are made of beryllium-copper and tin plated to prevent galvanic corrosion which would lead to electrical failure. It has been found that contact with the foam blocks scrapes off this protective tin plating.

The present invention provides protection for electrical connector pins by enclosing them without coming into contact with them. Thus, there is no possibility that they will be bent by the attachment of the protective apparatus or have their protective tin plating rubbed off. As the present invention fits relatively snuggly about the pins and has a slim configuration, it allows for a more economical use of storage space as well as greater ease in handling when compared to polyurethane foam blocks.

SUMMARY OF THE INVENTION

The present invention is an apparatus to removably enclose and thereby protect electrical connector pins installed in circuit boards. The pin protector has parallel flanges and a hinge to provide for the opening of a tubular enclosing section to allow it to be placed about the pins. The protector does not make contact with the pins either during or after its application. The memory properties of the hinge keep the enclosing section securely fastened in position about the pins. The pin protector is formed from an extrusible material and thus can be produced in any length without requiring the mold to be changed.

STATEMENT OF THE OBJECTS OF THE INVENTION

An object of the present invention is to protect fragile electrical connector pins from being bent, broken, or contaminated during their storage and handling;

Another object of the present invention is to provide an apparatus for protecting electrical connector pins which may be easily and quickly applied and removed;

Yet another object of the present invention is to provide an apparatus for protecting electrical connector pins which will not bend or break them during its application or removal;

Still another object of the present invention is to provide an apparatus for protecting electrical connector pins which is not bulky or cumbersome, but provides for the efficient use of storage space and the easy handling of the protected pins;

A further object of the present invention is to provide an apparatus for protecting electrical connector pins without rubbing off their protective tin plating;

Other objects, advantages and novel features of the invention will become apparent from the following detailed description of the invention when considered in conjunction with the accompanying drawings wherein:

DESCRIPTION OF THE PREFERRED EMBODIMENT

Figure 1:
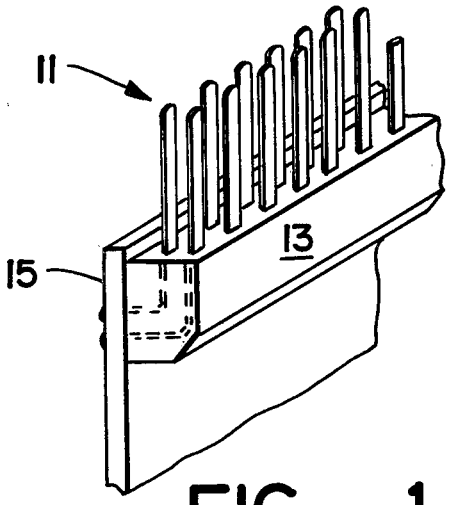
FIG. 1 is a perspective view of a set of electrical connector pins attached to a circuit board prior to the attachment of the preferred embodiment of the present invention about them.
Figure 2:
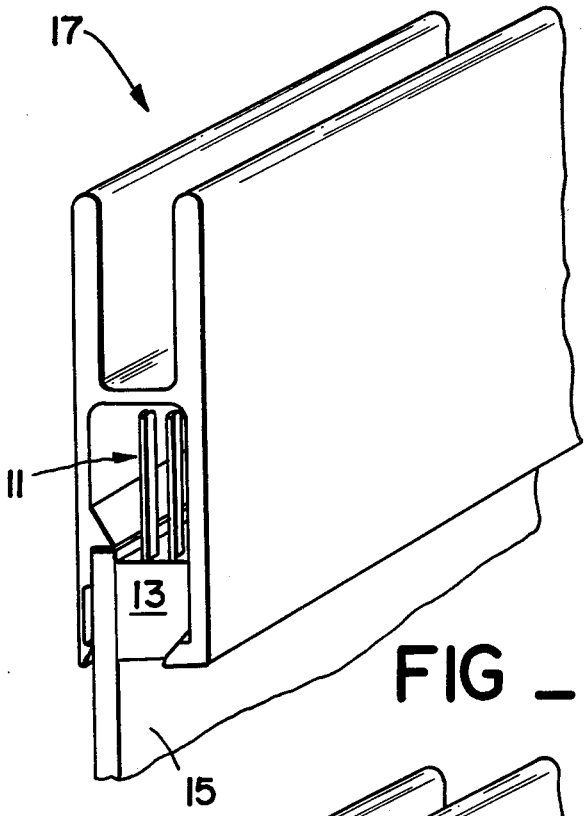
FIG. 2 is a perspective view of the preferred embodiment of the present invention operatively attached about and enclosing a set of connector pins.

FIG. 1 is a perspective drawing showing the type of apparatus that the present invention is intended to protect. The pictured apparatus is comprised of connector pins 11 fixedly installed in pin head 13 and head 13 soldered to circuit board 15. As pins 11 are easily bent and broken during storage and handling, pin protector 17 is designed to enclose them and thereby insulate them from damaging contact with foreign objects. The operative positioning of protector 17 enclosed about pins 11 is shown in FIG. 2.

Figure 3:
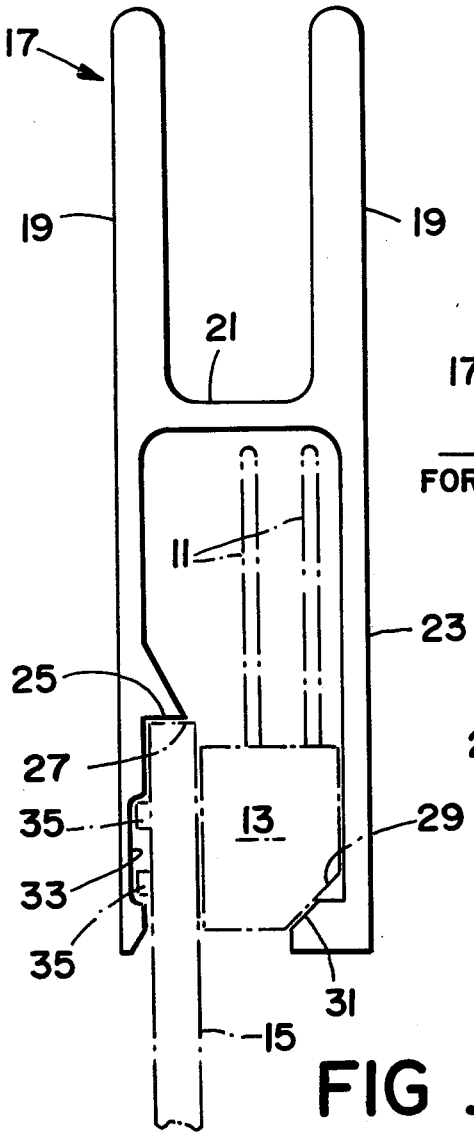
FIG. 3 is a side view of the preferred embodiment of the present invention shown operatively enclosing a set of electrical connector pins attached to a circuit board (The pins and board are shown in phantom).

FIG. 3 is a side view of protector 17 and also shows enclosed pins 11, head 13, and circuit board 15 in phantom. Protector 17 is comprised of parallel flanges 19 attached to hinge 21. Hinge 21 also forms one wall of pin enclosure section 23.

As shown, the interior surface of enclosure section 23 is shaped to enclose pins 11 without coming into contact with them during its application, storage, or its removal. The innate memory of hinge 21 presses the opposing sides of section 23 towards each other and thus into contact with head 13 and board 15. The contact between enclosure surface 25 and board surface 27 prevents the downward movement of protector 17 relative to pins 11. The contact between head surface 29 and enclosure surface 31 prevents the upward movement of protector 17 relative to pins 11. Recessed space 33 provides clearance for solder pads 35 located on board 15.

Figure 4:
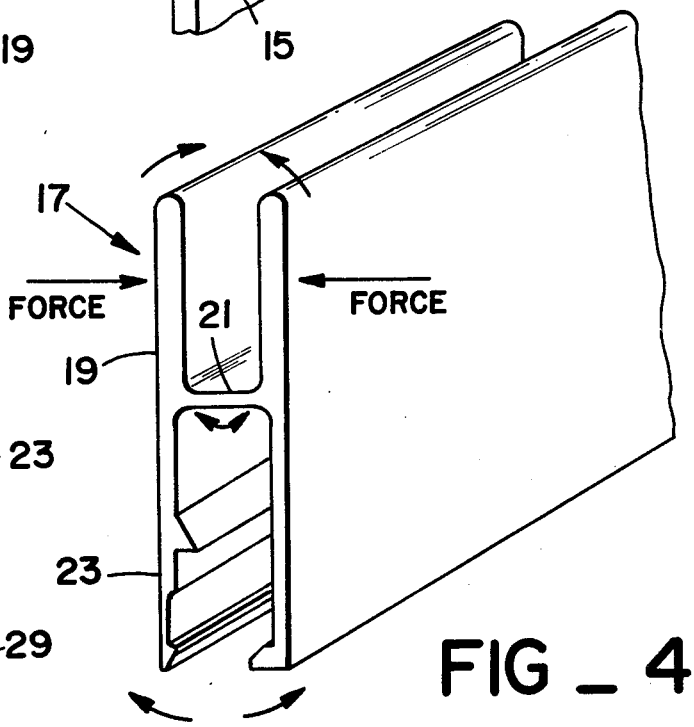
FIG. 4 is a perspective view of the preferred embodiment of the present invention showing where force should be applied in order to open the tubular enclosing section to provide for its attachment about connector pins (or remove it from the pins)

Referring to FIG. 4, protector 17 is applied (or removed) by applying sufficient force against the outward facing surfaces of parallel flanges 19. Such force causes flanges 19 to move towards each other, causes hinge 21 to bow, and concomitantly forces the opposing walls of enclosure section 23 apart to allow section 23 to be placed about (or removed from) pins 11. When the force is removed, the memory of hinge 21 forces the opposing walls of enclosure section 23 to move towards each other and, as herein before discussed, into contact with board 15 and head 13 so as to securely position enclosure section 23 about pins 11.

It should be noted that there is no physical constraint to prevent the lateral movement of protector 17 relative to pins 11, head 13, or board 15. Thus, if convenient, protector 17 may be applied or removed by sliding it over the adjoining surfaces of head 13 and board 15. This method of application or removal will not result in any contact between protector 17 and pins 11, and is within the intended usage of the present invention.

Protector 17 is preferably formed from ultra-high molecular weight polyethylene having a molecular weight of $10\times10^6$, as contrasted with regular polyethylene which has a $5\times10^5$ molecular weight. (Such ultra-high molecular weight polyethylene is produced by the Allied Chemical Corporation and denoted by it as polyethylene 1222.) Protector 17 may also be formed from Nylon (produced by the DuPont Corporation), although it has been found that the polyethylene has superior shape retention qualities.

Manufacture of pin protector 17 from either of the aforementioned materials allows protector 17 to be formed by the process of extrusion. This allows potential users to easily produce protector 17 to suit particular length requirements by merely cutting off the length of extruded protector which matches the length of the circuit board and pin head assembly the pin protector is to be used with. No adjustment need be made to the mold.

What is claimed:

1. A circuit board assembly in combination with a circuit board pin protector comprising:

(a) a solid elongated head having a plurality of upwardly extending pins and an elongated circuit board connected to said head, said head having a beveled edge extending the length of said head and a plurality of solder pads extending outwardly along the length of said circuit board;

(b) a pin protector including first and second hollow elongated tubes having a common wall therebetween, said second tube having rigid walls and an open side and sharing said common wall with said first tube, said first tube having first and second spaced apart rigid walls and an opening that extends the length of said first tube, said first wall including a solder pad recess that extends the length of said first wall, and said second wall including an elongated locking member that depends from the lower edge of said second wall and towards said first wall; and (c) said circuit board assembly being positioned within said first tube whereby said plurality of solder pads are positioned within said solder pad recess and said elongated locking member abuts said beveled edge.

2. The circuit board assembly in combination with a circuit board pin protector as recited in claim 1 including:

(a) said first wall of said first tube including a solid member depending outwardly from said first wall towards said second wall and extending the length of said first wall; and (b) said circuit board assembly being positioned within said first tube whereby said solid member abuts the uppermost surface of said circuit board.

3. The circuit board assembly in combination with a circuit board pin protector as recited in claim 2 wherein:

(a) said pin protector is constructed of an extrusible material.

4. The circuit board assembly in combination with a circuit board pin protector as recited in claim 2 wherein:

(a) said pin protector is constructed of a material from the group consisting of polyethylene having an ultra-high molecular weight of $10\times10^6$ and Nylon.

* * * * *